US006134716A

United States Patent [19]

Richardson

[11] Patent Number: 6,134,716

[45] Date of Patent: Oct. 24, 2000

[54] DISPOSABLE SMOKE MASK WITH REPLACEABLE FILTER

[76] Inventor: James M. Richardson, P.O. Box 7095, Dunes Station, Myrtle Beach, S.C. 29577

[21] Appl. No.: 09/411,488

[22] Filed: Oct. 4, 1999

[51] Int. Cl.[7] ..... A42B 1/04

[52] U.S. Cl. ..... 2/202; 2/171.2; 2/173

[58] Field of Search ..... 2/171.2, 202, 173; 128/206.12, 206.16

[56] References Cited

U.S. PATENT DOCUMENTS

| | | | |
|---|---|---|---|
| 2,800,901 | 7/1957 | Monro | 128/201.25 |
| 4,870,959 | 10/1989 | Reisman et al. . | |
| 5,146,636 | 9/1992 | De La Pena . | |
| 5,392,465 | 2/1995 | Shou . | |
| 5,452,712 | 9/1995 | Richardson | 128/201.25 |
| 5,526,804 | 6/1996 | Ottestad . | |
| 5,617,849 | 4/1997 | Springett et al. . | |
| 5,653,225 | 8/1997 | Schegerin . | |
| 5,875,775 | 3/1999 | Nur et al. . | |
| 5,881,389 | 3/1999 | Fruge | 2/202 |
| 5,884,336 | 3/1999 | Stout | 2/206 |
| 5,978,967 | 11/1999 | Williams | 2/174 |

*Primary Examiner*—Bibhu Mohanty
*Attorney, Agent, or Firm*—Rhodes & Mason, PLLC

[57] ABSTRACT

A smoke mask including a hood adapted to fit over a user's head, the hood having a front section adapted to be placed in front of a user's face; and a filter extending through the hood. The filter having support frame having a filter cartridge receiving opening, a replaceable cartridge containing at least one filtration medium positioned within the opening, and at least one releasable connector securing the cartridge to the frame.

13 Claims, 4 Drawing Sheets

DISPOSABLE SMOKE MASK WITH REPLACEABLE FILTER

BACKGROUND OF THE INVENTION (1) Field of the Invention

The present invention is related generally to disposable smoke masks of the type that are fittable over a person's head, and more particularly to a smoke mask of this type with a replaceable filter cartridge to allow for extended usage.

(2) Description of the Prior Art

The prior art describes various smoke masks for use by individuals who need to escape from a burning building or other smoke-filled environment. Generally, these masks are comprised of a hood that encloses the user's head, a visor in the hood to be positioned before the user's eyes, and a filter normally positioned in front of the user's mouth. A separate exhaust port may also be positioned in the hood for expiration.

In order to by effective and commercially feasible, the mask must be economical to produce and disposable. In addition, the mask must be easily donned by an inexperienced user under highly stressful conditions, while still being designed to exclude smoke or other contaminants from inhalation.

Many prior art disposable gas masks have a rubber-type main body that must be stretched when pulled over the user's head. The mask is designed to cling about the person's head to prevent contaminated air from passing by the gas mask and exposing the wearer to the contaminated air. Prior art filters typically include an outer particulate layer to remove particulate matter from the contaminated air, and an inner carbon-activated layer to absorb gaseous contaminants. Generally, the carbon-activated layer is formed of a carbon-saturated material that is effective for only a relatively short time.

U.S. Pat. No. 5,452,712 to the present inventor, incorporated herein in its entirety, describes a smoke mask that provided several improvements over these prior art masks. The mask described in that patent (referred to herein as the '712 mask) is comprised of a hood that fits loosely over the wearer's head, instead of being tightly stretched over the head. A transparent visor, a filter cartridge, and an exhaust valve are positioned in the front portion of the hood.

The mask is secured to the user's head and face in a manner excluding smoke and other contaminants by an elastic strap that is secured at its ends to opposite sides of the mask. Normally, the strap extends across the area of the mask overlying the forehead of the wearer. When used, the strap is pulled downwardly and under the chin, forming a seal extending along opposite sides of the front portion of the mask and under the chin of the wearer.

The '712 mask may also include a second strap that is attached at one end to one side of the bottom portion of the hood. The second strap wraps around behind the neck of the subject, around the opposite side of the neck, underneath the chin, and then extends back up the opposite side of the hood where the other end of the second strap attaches to the smoke mask structure, e.g., with a hook-and-loop fastener.

The filter used in the '712 mask can be of a three-layer or four-layer construction. The three-layer filter includes a particulate filter layer to remove particulates; an activated carbon layer to absorb harmful gases; and a carbon monoxide catalyst layer to convert carbon monoxide to carbon dioxide. The activated carbon layer is preferably formed of a solid bed of carbon for extended usage. The four-layer filter also includes a desiccant filter layer to remove moisture and thereby increase the effectiveness of the activated carbon and/or carbon monoxide catalyst layers.

The layers of filter material may be enclosed within a housing to form a multi-stage filter cartridge. In the preferred embodiment of the '712 mask the multi-stage filter cartridge includes a first generally rectangular or square section and an integrally formed, generally cylindrical rear section having a smaller cross-sectional area. Contaminated air or smoke enters the first section, where it passes through particulate and dessicant filter layers, and then through the rear section that includes the activated carbon filter layers, and optionally the carbon monoxide catalyst filter layer.

The filter pack is secured to the hood by encapsulating the front section of the housing in a plastic covering and fusing the covering to the hood. A circular seal is also used to permanently seal the covering around the front portion of the cylindrical rear section at its juncture with the front section.

While the '712 mask provides several advantages over prior art smoke masks, further advances are still needed. In particular, there is a need for a smoke mask that permits extended usage while still meeting the requirements of economy and disposability. In addition, there is a need for a mask design that is more easily donned under stressful conditions. There is also a need for a mask design that further reduces the stress to the wearer during use. These and other needs are addressed by the smoke mask of the present invention.

SUMMARY OF THE INVENTION

The disposable smoke mask of the present invention, like the '712 mask, is comprised of a hood that is fittable over the user's head, with the hood including a visor, a filter, and a means for attaching the hood securely around the wearer's face and neck to minimize penetration of smoke and contaminants. However, the present mask provides improvements in the nature of the filter, the visor, and the manner in which the hood is secured about the user's neck. After a reading of the following description, it will be apparent that these improvements can be adapted individually or in combination.

Under most circumstances, the '712 mask will enable a user to escape from the confines of a burning building or other smoke filled area, providing filtered air for the time period required to exit the premises. In some environments, however, the filter used in the '712 mask can be saturated before the user is able to reach a safe, smoke-free location. For example, individuals may need to escape from the upper floors of a high-rise building, or from an area where the closest available exit is blocked. Under these conditions, prolonged filtration capabilities will be required.

The present invention addresses this need by providing a smoke mask with a filter cartridge that can be quickly and easily replaced by the user while wearing the mask in the smoke-filled environment. Thus, if the user is still within the smoke-filled area when the initial filter becomes saturated, the user can replace the initial filter cartridge with a replacement filter cartridge, effectively doubling the time during which the user can remain in the smoke-filled area without harm.

Essentially, the improved mask is comprised of a hood that includes a filter comprised of a filter cartridge receiving frame secured about an opening in the hood to be positioned generally in front of the user's face, and a replaceable filter cartridge fitted into the frame. An attachment means is used to releasibly connect the filter cartridge to the frame.

The frame is comprised of a continuous outer annular member that extends around a filter cartridge insertion opening in the front of the hood. The outer frame member has an inner surface that is sealed in an air impervious manner to the outer surface of hood around the filter cartridge insertion opening. Preferably, the frame also includes a continuous inner annular member having a central opening corresponding in size to the central opening of the outer member. The inner annular member is sealed in an air impervious manner to the inner surface of the hood around the filter insertion opening.

Preferably, the outer and inner frame members are also secured to each other. For example, attachment pins can extend from one of the members through the hood and through corresponding attachment holes in the other member. In the preferred embodiment of the invention, the frame members and their central openings are rectangular. It will be understood, however, that the frame members and/or their opening may be circular or of other shapes.

The replaceable filter cartridge of the present invention is comprised of a housing that encloses a filter medium. The housing includes a outer inlet for entry of smoke-filled air and an inner outlet, generally on the opposite side of the filter medium from the inlet, for discharge of purified air into the interior of the mask for breathing. The housing, similar to the housing of the '712 mask, may be comprised of an outer section and an integral inner section.

The filter cartridge and the frame also include facing engagement surfaces that prevent entry of smoke between the cartridge and frame when the filter is secured in the frame. A gasket may be used between the engagement surfaces to ensure proper sealing. The cartridge and frame are also held together by a releasable connector or attachment means, such as a latch, pin or lock, that is attached to one of the filter elements, i.e, the cartridge or the frame, with the attachment means being moveable between an unengaged position and an engaged position in contact with the other element of the filter.

The filter may also include a flexible seal that covers the filter insertion opening when the initial filter cartridge is removed for insertion of the second filter cartridge. This seal minimizes the amount of smoke that enters the interior of the mask when the filter cartridge is being changed. Preferably, the seal is comprised of a flexible sheet of rubber or plastic material that extends across the filter insertion opening, with a closable opening in the sheet.

For example, a plurality of radial cuts can extend from a central point, so that triangular segments of the sheet open when the new cartridge is inserted. This type of closure is often referred to as a "tulip" lens opening. The sheet also stretches about the periphery of the cartridge housing to prevent contaminated air from entering between the housing and seal. The edge of the seal can be secured between the inner and outer frame members.

The filter medium can be a single material or layers of different materials. Preferably, the filter medium is comprised of three or four layers of materials having the composition of the type used in the '712 mask. That is, a particulate filter layer; an activated carbon layer; a carbon monoxide catalyst layer; and, optionally, a desiccant filter layer.

The '712 mask, as well as prior art masks in general, include a visor fitted within an opening positionable in front of the user's eyes. A hood with a visor of this type, which is typically about the size of a pair of glasses or goggles, has the potential to create apprehension and a feeling of claustrophobia under the circumstances in which it is used. Moreover, the hood may slip from the desired orientation, making it difficult for the user to see through the visor.

The present invention overcomes these deficiencies by providing a mask having a hood that is constructed of a transparent front panel, and a back panel. The front panel of the present hood comprises at least about the front half of the hood. As a result, the user gains a more "open" feeling since the face is not covered by an opaque material. Also, in the event the hood slips from its desired position, the view will not be impaired. When a hood of this construction is used, the filter inlet opening extends through the transparent part of the hood.

The front and back sections of the hood are joined by sealing their abutting edges in an air impervious manner, e.g., by heat sealing. The front and back sections of the hood are made from a heat and fire retardant flexible, pliable material, such as vinyl or other plastics of the type that will be readily apparent to one skilled in the art.

The hood also includes a means for securing the hood about the user's head so that contaminated air does not enter the interior of the hood during use. For example, the hood may include a chin strap of the type described in connection with the '712 mask. A second strap of the type used with the '712 mask may also be used.

In some circumstances, it may be cumbersome or time consuming for an individual to attach the second strap behind the neck, and under the chin, and then attach the end of the strap to the side of the neck. Alternatively, the second or neck strap can be replaced with a draw strap or string that extends around the user's neck when the hood is in place. This draw strap is comprised of a string that extends around the neck area of the hood, preferably through a channel between two layers of material. The ends of the strap extend to the front of the hood and are joined by a slidable, releasable catch or lock.

Thus, when all of the improvements are incorporated into a smoke mask, the smoke mask is comprised of a hood having a transparent front section extending substantially over the entire facial area, with a filter receiving opening within the front of the hood, a filter frame secured to the hood around the filter receiving opening, a replaceable filter cartridge releasibly secured in the filter frame, and a sealing strap to secure the hood to the user's head.

In operation, the user places the hood over his or her head with the transparent section toward the front, and tightens the sealing strap to prevent contaminated air from entering the interior of the hood. The user then proceeds to exit the contaminated area. In the event that the filter cartridge becomes saturated before the user reaches a safe, uncontaminated area, the user removes the initial filter cartridge from the filter and quickly replaces the initial filter cartridge with a new filter provided with the mask, thereby doubling the user's time for escape.

Accordingly, one aspect of the present invention is to provide a smoke mask comprising a hood adapted to fit over a user's head, the hood having a front section adapted to be placed in front of a user's face; and a filter extending through the hood, the filter having a frame with a opening attached to the hood, and a filter cartridge releasibly mounted in the frame opening.

Another aspect of the present invention is to provide a smoke mask comprising a hood adapted to fit over a user's head, the hood having a transparent front section adapted to be extend substantially across the area of a user's face, and a filter extending through the front section.

Still another aspect of the present invention is to provide a filter forming part of a smoke mask comprising a support frame having a filter cartridge receiving opening, a replaceable cartridge containing at least one filtration medium positioned within the opening, and at least one releasable connector securing the cartridge to the frame.

These and other aspects of the present invention will become apparent to those skilled in the art after a reading of the following description of the preferred embodiment.

DETAILED DESCRIPTION OF THE INVENTION

Figure 2:
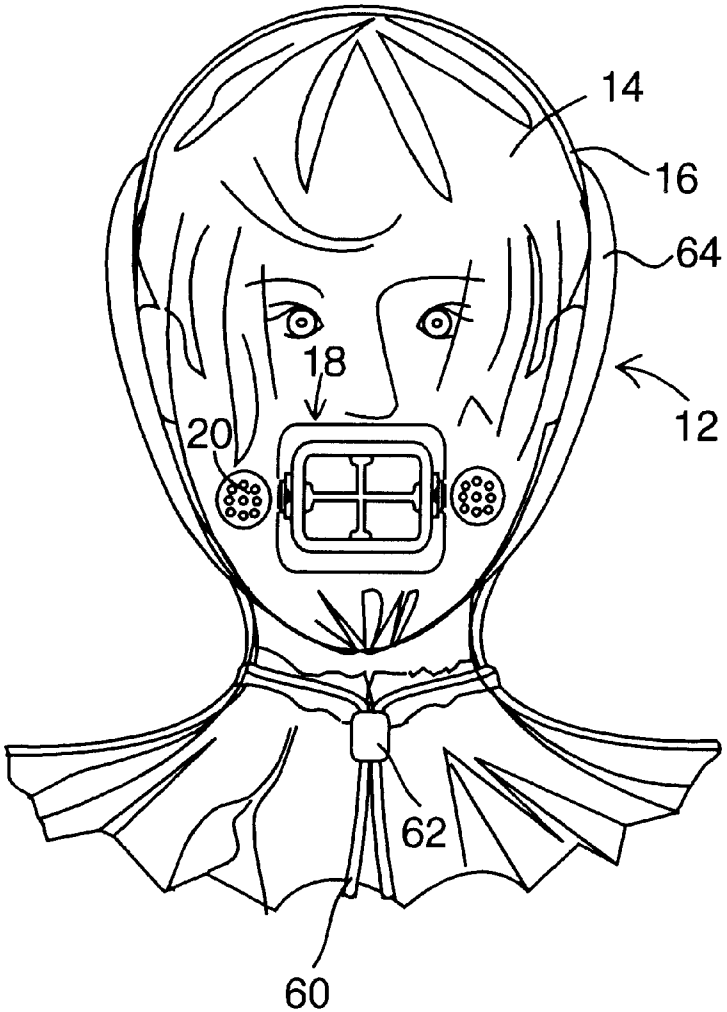
FIG. 2 is a front view of a user after the neck and chin straps are in place.
Figure 1:
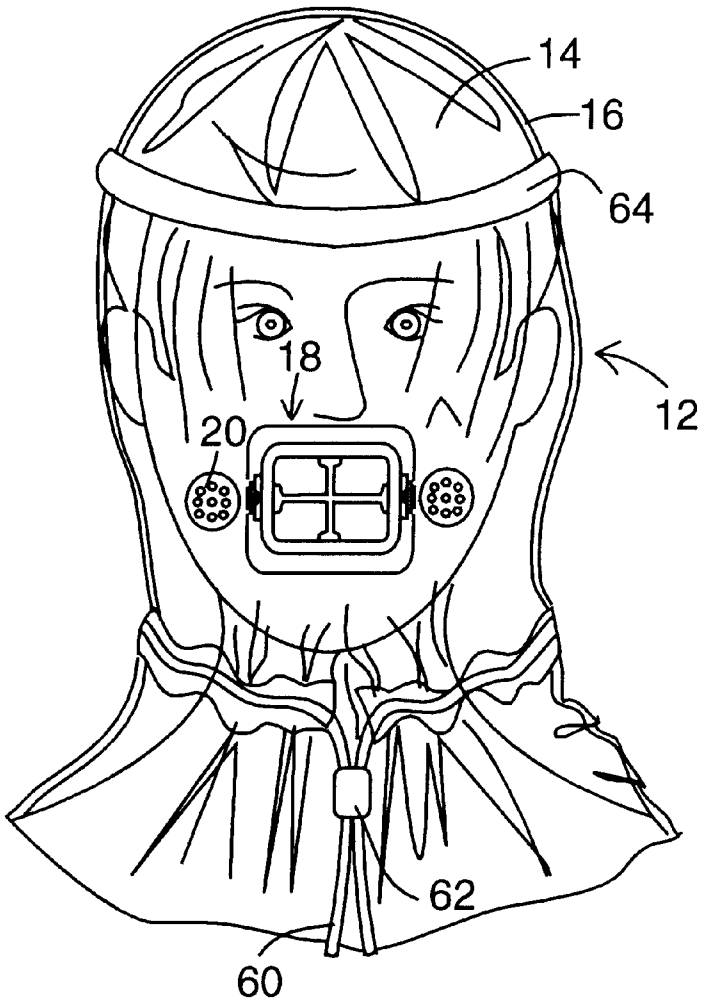
FIG. 1 is front view of a user immediately after donning the smoke mask.
Figure 3:
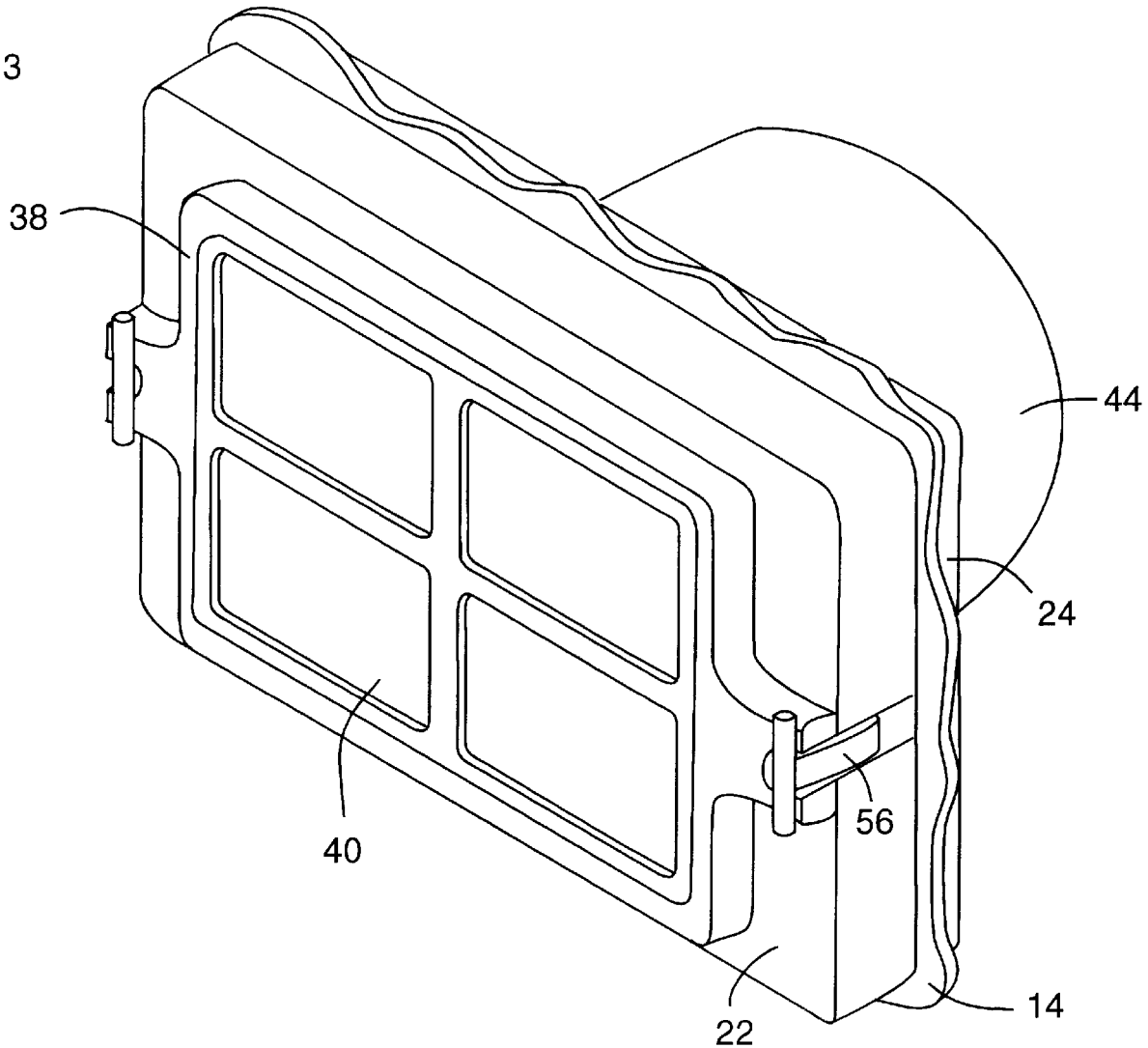
FIG. 3 is perspective view of the filter of the present invention with a part of the front hood section to show positioning of the filter.
Figure 4:
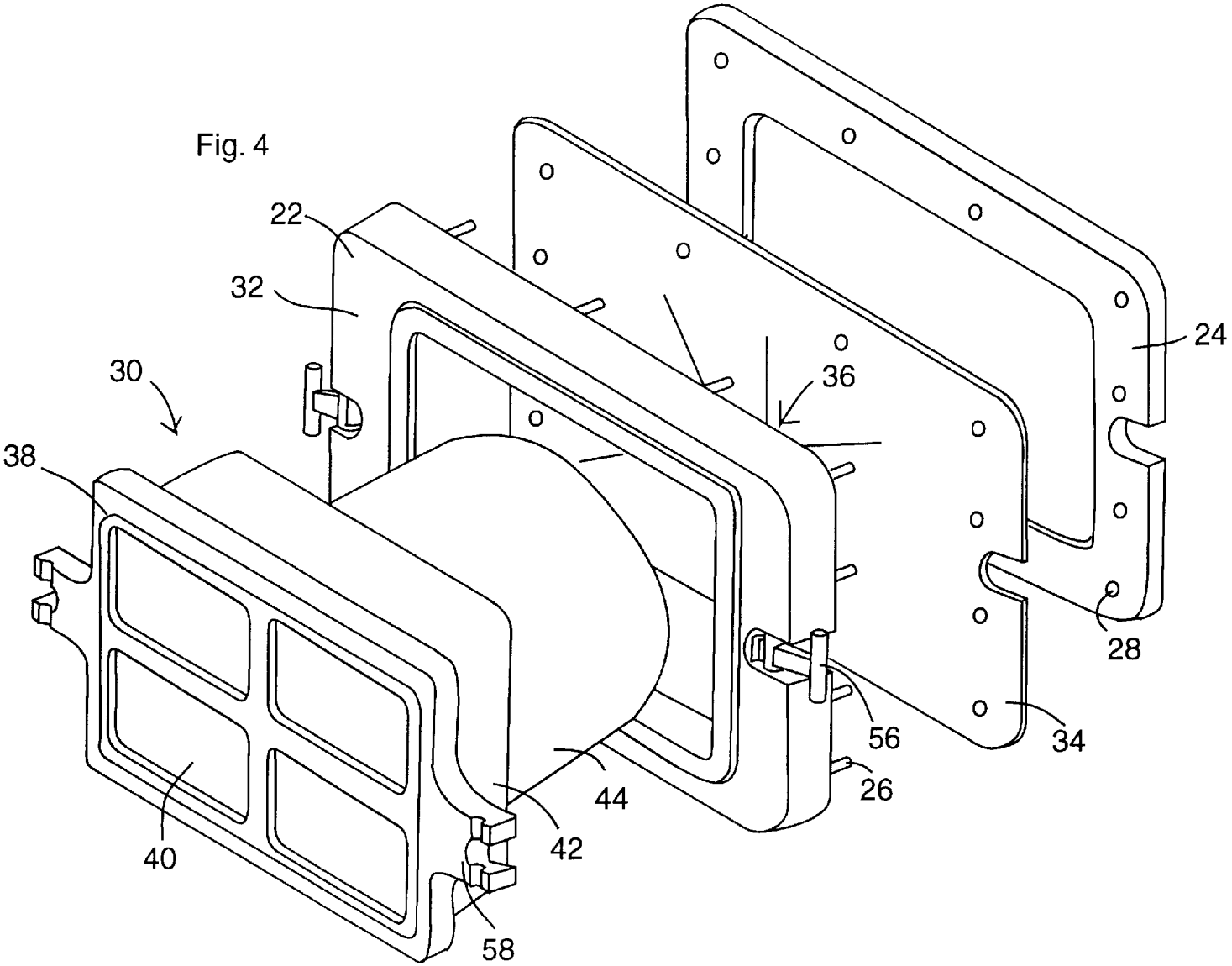
FIG. 4 is an exploded, perspective view of the filter of the present invention.
Figure 6:
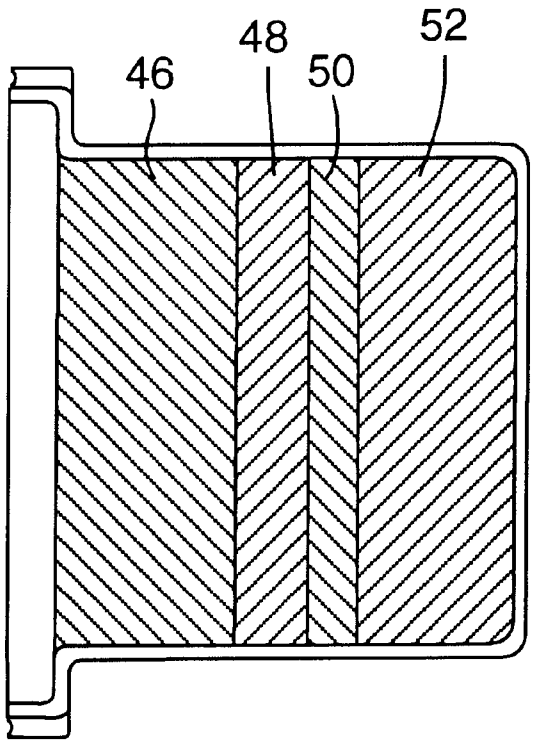
FIG. 6 is a sectional side view of the filter of the present invention.
Figure 5:
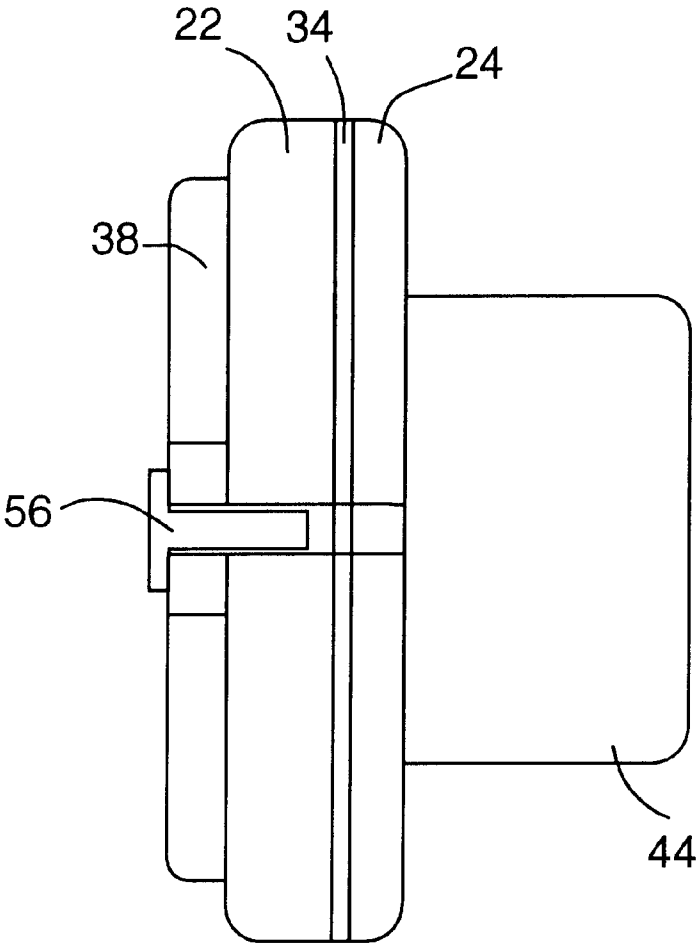
FIG. 5 is a side view of the filter of the present invention.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

The disposable smoke mask of the present invention is comprised of a hood, generally 12, comprised of a transparent front section 14 extending generally over the user's facial area, and a back section 16, which may be opaque or transparent. Sections 14 and 16 may also be made of a single sheet of material. A filter 18 is fitted into an opening in section 14 so that filter 18 is in front of the user's nose and mouth when hood 12 is donned. One-way valves 20, which preferably have reflective front surfaces to assist in locating the user, are positioned on either side of filter 18.

Filter 18 is comprised of an outer filter cartridge receiving frame 22 in the shape of a rectangular annular frame that extends around a central opening, and an inner filter cartridge receiving frame 24 of a similar construction. Frames 22 and 24 are positioned on the outer and inner surfaces, respectively, of hood front section 14 around an opening in section 14 of approximately the same dimensions as the central openings in frames 22 and 24.

Frame 22 includes inwardly projecting pins 26 that are inserted into pin receiving holes 28 in frame 24 when the frames are positioned on opposite sides of section 14. The outer ends of pins 26 are then heated in a known manner to permanently secure frames 22 and 24 against hood section 14.

Filter 18 also includes a replaceable filter pack or filter cartridge 30 insertable through the central openings in frames 22 and 24. An annular gasket 32 is positioned on the front surface of frame 22 around the central opening to prevent air leakage between frame 22 and filter cartridge 30 when filter 18 is assembled.

A flexible membrane or sheet 34 is positioned between frames 22 and 24. Sheet 34 includes a closeable opening 36 formed of a plurality of inwardly directed flexible fingers produced by a plurality of radially intersecting slits. Filter cartridge 30 is comprised of a front plate 38 that includes air inlet 40, a rectangular filter medium housing 42 extending rearwardly from plate 38, and a cylindrical filter medium housing 44 integral with and extending rearwardly from housing 42.

Filter cartridge 30 can be filled with a single filter medium, or a plurality of filter media, depending upon the design and desired end use. In the preferred embodiment, filter cartridge 30 includes a filter medium comprised of a first particulate filter layer 46; a second a desiccant filter layer 48; a third activated carbon layer 50; and a fourth carbon monoxide catalyst layer 52.

Contaminated air is drawn into filter cartridge 30 through air inlets 40, and then successively through filter layers 46, 48, 50 and 52, to remove contaminants. The purified air is then drawn into the interior of hood 12 though openings 54 in the rear of housing 44. Exhaled air is exhausted from hood 12 through one-way valves 20.

Filter cartridge 30 is held within frames 22 and 24 by pivotal latches 56 that extend outwardly from the sides of frame 22. Latches 56 can be opened outwardly to an unengaged position to remove cartridge 30 and pivoted forward to engage latch-receiving members 58 that project outwardly from filter cartridge front plate 38.

The smoke mask of the present invention is stored with a filter cartridge 30 in position. When the smoke mask is needed, the user pulls hood 12 over his or her head, positioning filter 18 in front of the nose and mouth. Drawstring 60 is then pulled securely around the neck and held in place by releasable holder 62. A stretchable strap 64 of the type shown in U.S. Pat. No. 5,452,712 can also be pulled down beneath the user's chin.

If the user has not escaped from the contaminated area when the first filter cartridge 30 is saturated, the user releases latches 56, and removes first filter cartridge 30. A second filter cartridge 30 is then inserted in place of first filter cartridge 30 and latches 56 are moved back to their engaged positions.

In order to minimize the entry of smoke or other contaminates into the interior of hood 12 during replacement of cartridge 30, inner cartridge housing 44 is inserted through the closable opening 36 in sheet 34 which, due to the flexibility of sheet 34 snugly engages the surface of housing 44 to prevent leakage. When cartridge 30 is removed, opening 36, due to the flexibility of sheet 34, closes to minimize leakage of contaminated air into hood 12 through opening 36. A new cartridge 30 is then inserted into frames 22 and 24 and through opening 36 which again snugly engages the surface of housing 44.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A smoke mask comprising:

a) a hood adapted to fit over a user's head, said hood having a front section adapted to be placed in front of a users face; and b) a filter extending through said hood, said filter having a frame with a opening attached to said hood, a filter cartridge releasibly mounted in said frame opening, and releasable connectors on the exterior of said filter, said connectors having an engaged position to secure said filter cartridge in said frame opening and an unengaged position.

2. The smoke mask of claim 1, wherein said front section is transparent and is adapted to extend substantially over the user's face.

3. The smoke mask of claim 1, wherein said hood includes a drawstring adapted to extend substantially around a user's neck.

4. The smoke mask of claim 1, wherein said mask further include at least one one-way exhaust valve extending through said hood.

5. The smoke mask of claim 1, wherein said mask further includes a flexible sheet across said frame opening, said sheet having a closeable opening through which said filter cartridge is inserted.

6. The smoke mask of claim 1, wherein said frame includes an outer frame section on the outside of said hood, and an inner frame section on the inside of said hood, said frame sections having mating filter cartridge receiving openings.

7. The smoke mask of claim 1, wherein said filter cartridge includes a plurality of filter media.

8. The smoke mask of claim 1, wherein said filter cartridge includes a front plate, a rectangular filter media housing extending inwardly from said front plate, and a cylindrical filter media housing extending inwardly from said rectangular filter media housing.

9. The smoke mask of claim 1, wherein said filter cartridge includes a sealing gasket between said frame and said filter cartridge, said gasket extending around said frame opening.

10. A smoke mask comprising:

a) a hood adapted to fit over a user's head, said hood having a transparent front section adapted to be extend substantially across the area of a user's face; and b) a filter extending through said front section in front of a user's face when said mask is being worn said filter including a frame secured to said transparent area, and a replaceable filter cartridge releasibly mounted in said frame.

11. The smoke mask of claim 10, wherein said hood further includes an opaque rear section.

12. The smoke mask of claim 10, wherein said hood includes a drawstring adapted to be tightened around the user's neck.

13. The smoke mask of claim 10, wherein said smoke mask further includes at least one one-way air valve extending through said transparent front section.

* * * * *